United States Patent [19]

Kitagawa et al.

[11] Patent Number: 4,602,255

[45] Date of Patent: Jul. 22, 1986

[54] LUGGAGE DOOR UNLOCKING DEVICE FOR VEHICLE

[75] Inventors: Junji Kitagawa; Shigeyuki Akita; Kouichi Yamanoue, all of Okazaki, Japan

[73] Assignee: Nippon Soken, Inc., Nishio, Japan

[21] Appl. No.: 603,334

[22] Filed: Apr. 24, 1984

[30] Foreign Application Priority Data

Apr. 25, 1983 [JP] Japan ..... 58-73550

[51] Int. Cl.[4] ..... G08C 19/00

[52] U.S. Cl. ..... 340/825.69; 340/63; 340/825.72; 179/82

[58] Field of Search ..... 367/199; 179/82; 361/172, 182, 171; 340/825.69, 63, 825.72, 310 A, 572, 825.31–825.34; 307/10 R, 10 AT, 9; 180/287, 289; 174/52 PE

[56] References Cited

U.S. PATENT DOCUMENTS

| | | | |
|---|---|---|---|
| 3,488,632 | 6/1970 | Clark | 340/825.72 X |
| 3,569,969 | 3/1971 | Lemon | 340/825.72 X |
| 3,879,709 | 4/1975 | Yukawa | 340/825.72 X |
| 3,937,976 | 2/1976 | McGuirk | 174/52 PE |
| 4,071,714 | 1/1978 | Satoh | 179/82 |
| 4,143,368 | 3/1979 | Route et al. | 340/63 X |
| 4,317,157 | 2/1982 | Eckloff | 340/825.69 X |
| 4,333,072 | 6/1982 | Beigel | 340/572 X |

*Primary Examiner*—Ulysses Weldon

*Attorney, Agent, or Firm*—Cushman, Darby & Cushman

[57] ABSTRACT

A luggage door unlocking device for a vehicle, capable of unlocking the luggage door of the vehicle without using an unlocking key includes a portable signal transmitter for transmitting an unlocking signal; signal receiving device provided on the vehicle, for receiving and discriminating the unlocking signal; and a driving device which drives an unlocking mechanism on the basis of the received and discriminated unlocking signal. The signal receiving device has a magnetic sensor, a smoothing circuit which smoothes the reception signal provided by the magnetic sensor and provides a smoothed signal, and a comparator which receives the reception signal and the smoothed signal and allows the reception signal to pass only when the signal level of the reception signal changes beyond the signal level of the smoothed signal. The noise overlapping the reception signal is eliminated by the comparator, whereby an unlocking signal including no noise is fed to the driving device.

7 Claims, 18 Drawing Figures

40
401
404
402
484a
484
45
453
451
452
442
44
441
433-c
433-b
433-i
483
481
472
47
COUNTER
Q12
Q2
Q6
Q14
462
461
C
471
46
43
432
431
Q9
Q0
COUN-TER
LATCH
R/S
D
P
E
41
OSC CKT
421
42
38a
403

Q0 Q1 Q4 Q5 Q7 Q0 Q1 Q4 Q5

33a
Sn
Sn
Sn
Sn

35a

36a

37a

38a 484a
0.2 sec

11sec

LUGGAGE DOOR UNLOCKING DEVICE FOR VEHICLE

BACKGROUND OF THE INVENTION

The present invention relates to a luggage door unlocking device for a vehicle, capable of unlocking the luggage door of a vehicle, particularly, the trunk lid, without using a key.

The luggage door unlocking device of this type comprises a portable signal transmitter for transmitting an unlocking signal comprising a pulse train; a receiver mounted on the vehicle body capable of receiving the unlocking signal transmitted by the portable signal transmitter when the transmitter is close by; and an unlocking means for operating an unlocking mechanism upon the reception of the unlocking signal by the receiver.

The luggage door unlocking device of this type enables the trunk lid to be opened automatically when a person carrying the signal transmitter approaches the trunk lid, thereby eliminating a manual unlocking operation, which is of great convenience in case the person has luggage in both hands.

Generally, the light, electromagnetic wave and ultrasonic wave are possible signaling media in such an unlocking device. The inventors of the present invention took notice of magnetism as a signaling medium or its comparatively satisfactory characteristics unaffected by the noises of the environment. However, it was found through experiments that, in an underground parking lot, the harmonic component of an induction field generated by a burried power cable or the like sometimes overlaps even a magnetic unlocking signal, as a pulse noise of a comparatively short duration. Accordingly, the conventional receiver which receives all the pulse signals of voltage levels above a fixed level as a normal unlocking signal has been likely to cause the erroneous operation of the associated unlocking means.

SUMMARY OF THE INVENTION

Accordingly, objects of the present invention are:

(1) to provide a luggage door unlocking device of reliable performance, employing magnetism as a signaling medium; and (2) to provide a luggage door unlocking device unaffected by noises generated by an induction field.

The luggage door unlocking device of the present invention comprises as the basic components:

(1) a portable signal transmitter capable of transmitting a magnetic unlocking signal of a high-frequency pulse train having a predetermined code;

(2) a magnetic sensor mounted on a vehicle and capable of receiving the magnetic unlocking signal as the signal transmitter is brought near and generating a reception signal;

(3) signal processing means capable of detecting the reception and generating a signal detection signal;

(4) signal discriminating means capable of generating an unlocking command signal only when the detection signal corresponds to the predetermined code and (5) driving means capable of actuating an unlocking mechanism upon the reception of the unlocking command signal.

The present invention is characterized by the above-mentioned signal processing means, which comprises:

(1) a smoothing circuit capable of smoothing the reception signal and providing a smoothed signal;

(2) a comparator receiving the reception signal and the smoothed signal and designed to let the reception signal pass only when the signal level of the reception signal changes beyond the signal level of the smoothed signal; and (3) a detection circuit for detecting the reception signal which has passed the comparator and generating a detection signal of a pulse train corresponding to the reception signal.

Thus, the comparator eliminates noises generated by a noise source, such as an induction field, and overlapping the reception signal and gives a detection signal including no noise to the signal discriminating means. Consequently, the luggage door unlocking device of the present invention functions surely even in an underground parking lot or the like.

FIGS. *7a–7l* is a timing chart showing the relative timing of the signals given by the above-mentioned circuits.

DETAILED DESCRIPTION OF THE INVENTION

Figure 1:
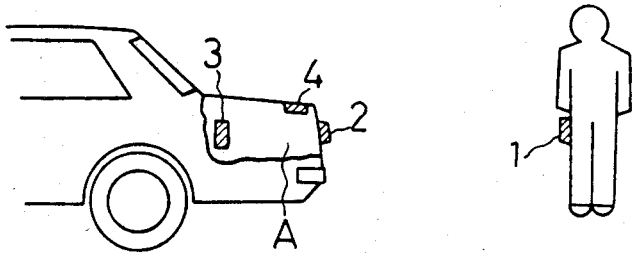
FIG. 1 is an illustration showing the disposition of the component equipment of the luggage door unlocking device of the present invention.

FIG. 1 shows an exemplary mode of the practical application of a luggage door unlocking device according to the present invention. There are shown a portable signal transmitter 1 designed to be carried by the driver and capable of transmitting an unlocking signal comprised of a high frequency pulse train having a predetermined code, a magnetic sensor 2 disposed in the rear part of a vehicle and a signal transmitter container 3 disposed within the trunk room A to store the signal transmitter 1. Various electric circuits, which will be described later, for receiving and discriminating the unlocking signal to actuate an unlocking mechanism 4 are built in the container 3.

Figure 2:
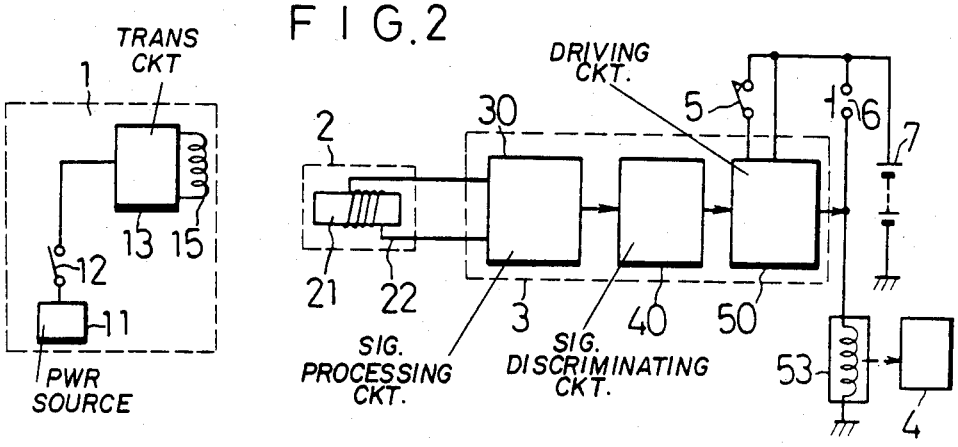
FIG. 2 is a block diagram showing the electric circuit of the luggage door unlocking device of the present invention.

FIG. 2 shows a block diagram of the electric circuit. The signal transmitter 1 has a built-in power source 11, a main switch 12, a transmission circuit 13 and a transmission solenoid 15. The magnetic sensor 2 consists of a magnetic core 21 of a square ferrite cylinder and a coil 22 formed by winding a wire on the magnetic core 21 and connected to a signal processing circuit 30 contained in the container 3. A signal discriminating circuit 40 provides an unlocking command signal only when a detection signal provided by the signal processing circuit 30 corresponds to the predetermined code. There are also shown a driving circuit 50 which provides a driving signal upon the reception of the unlocking command signal, a solenoid 53 of an actuator for actuating the unlocking mechanism 4 upon the reception of the driving signal, a key switch contact 5 which opens when the engine is stopped, a trunk opening switch 6 provided near the driver's seat, and a battery 7 of the vehicle.

Figure 3:
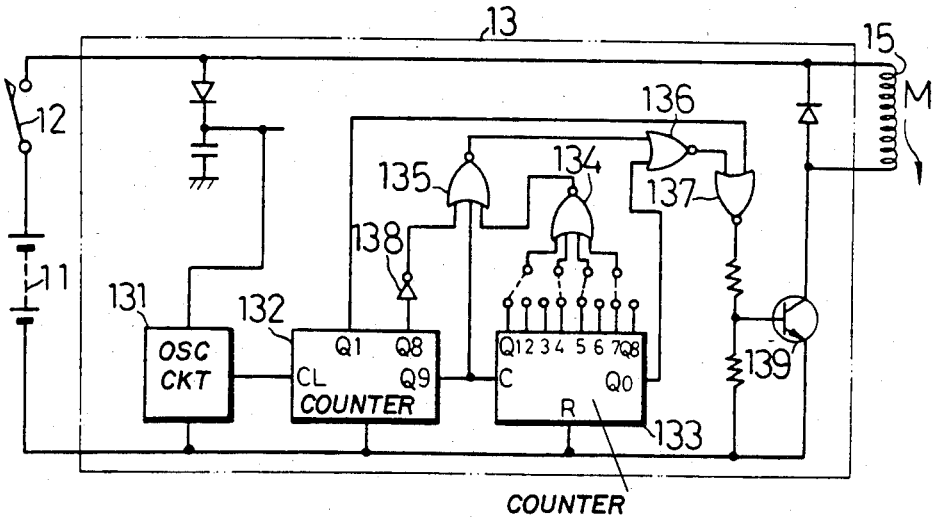
FIG. 3 is a circuit diagram of the portable signal transmitter.

FIG. 3 shows the constitution of the transmission circuit 13 of the signal transmitter 1. The transmission circuit 13 generates the unlocking signal consisting of a repetitive high-frequency pulse train having the predetermined code by the agency of an oscillation circuit 131, a binary counter 132, a decimal counter 133, NOR gates 134, 135, 136 and 137 and an inverter 138. A transistor 139 energizes the transmission solenoid according to the unlocking signal to generate a magnetic signal M. Various different coded unlocking signals can be formed according to the mode of interconnection of the decimal counter 133 and the NOR gate 134.

Figure 4:
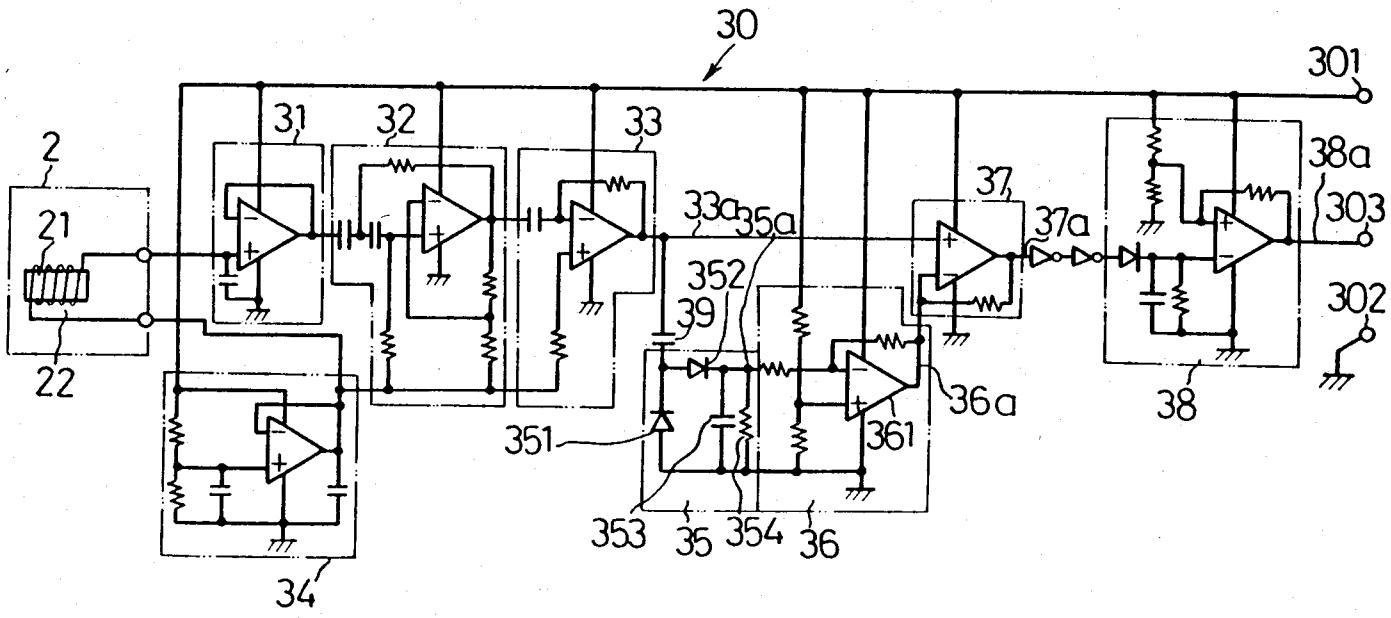
FIG. 4 is a circuit diagram of the signal processing circuit.

FIG. 4 shows the constitution of the signal processing circuit 30. The signal processing circuit 30 comprises a buffer 31, a band pass filter 32, an amplifier 33, a constant-voltage regulating circuit 34, a smoothing circuit 35, an inverting circuit 36, a comparator 37, and a detection circuit 38. The amplifier 33 and the smoothing circuit 35 are interconnected via a coupling condenser 39. A terminal 301 is connected to a constant-voltage circuit which will be described later. A terminal 302 is a grounding terminal. A terminal 303 is connected to the signal discriminating circuit 40 and gives therefrom a detection signal 38*a*.

Figure 5:
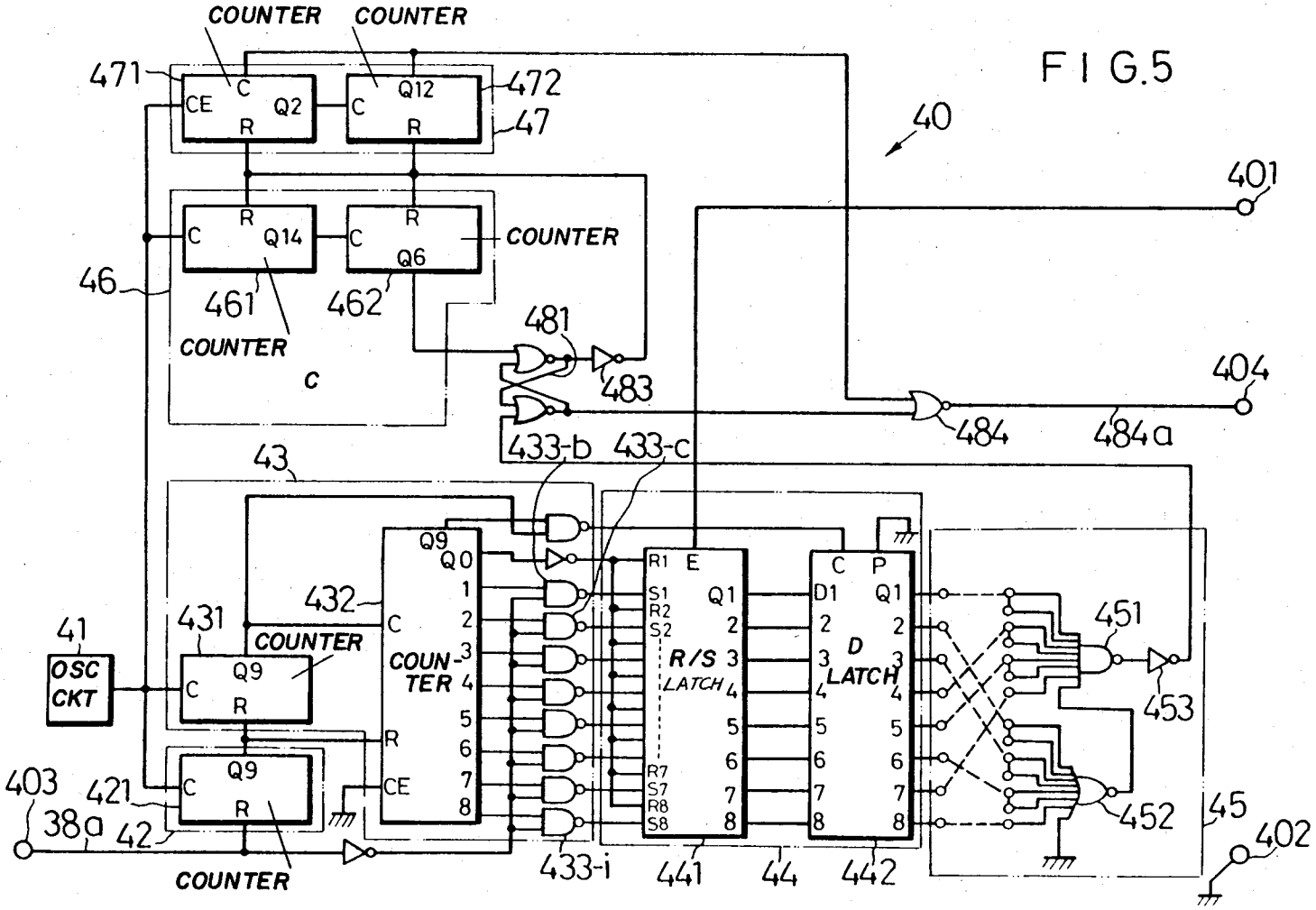
FIG. 5 is a circuit diagram of the signal discriminating circuit.

FIG. 5 shows the constitution of the signal discriminating circuit 40. A terminal 403 is connected to the terminal 303 shown in FIG. 4. Reference numeral 41 designates an oscillation circuit. A reset signal generating circuit 42 is a binary counter 421. An address detection circuit 43 converts the pulse train of the detection signal given by the signal discriminating circuit 40 into a parallel arrangement to generate an address signal. The address detection circuit 43 comprises a binary counter 431 and a decimal counter 432. A memory circuit 44 for storing the signal given by the address detection circuit 43 comprises a R/S latch 441 and a D latch 442. A discrimination circuit 45 for deciding whether or not the address signal has the predetermined code comprises a NAND gate 451 and a NOR gate 452. A time circuit 47 for limiting the application of an output signal to the successive driving circuit 50 within a fixed time comprises binary counter 471 and 472. An inhibiting circuit 46 for inhibiting the application of a signal to the driving circuit 50 for a fixed period of time comprises binary counters 461 and 462. A terminal 401 is connected to a constant-voltage circuit which will be described later. A terminal 402 is a grounding terminal. A terminal 404 is connected to the driving circuit 50.

Figure 6:
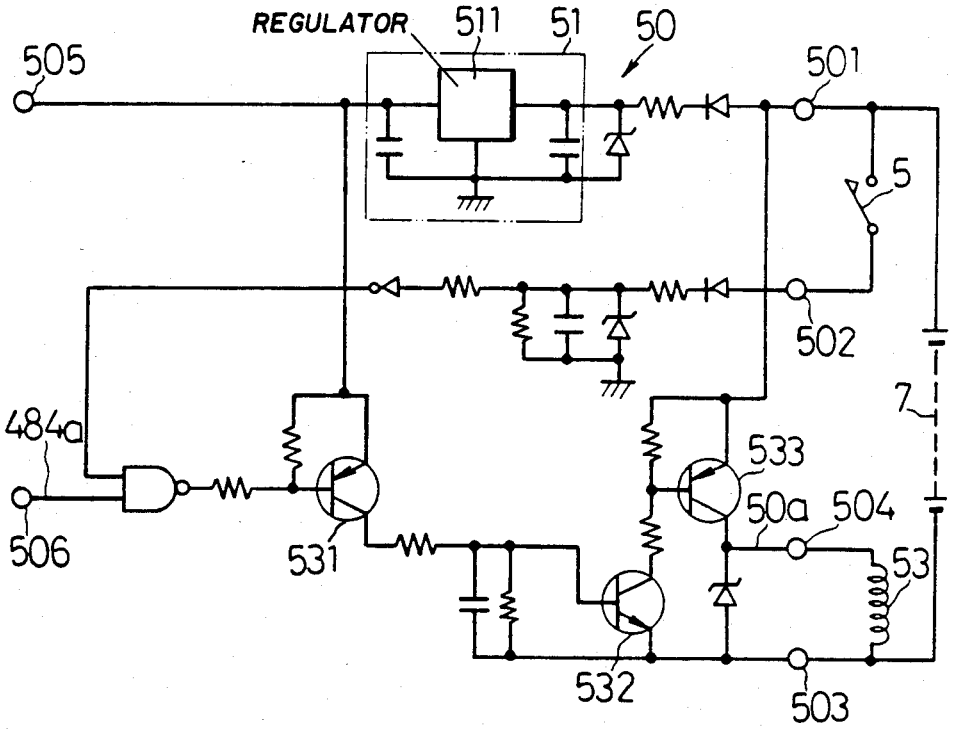
FIG. 6 is a circuit diagram of the driving circuit.

FIG. 6 shows the constitution of the driving circuit 50. Terminals 501, 502, 503 and 504 are connected to the battery 7 of the vehicle, the contact of the key switch 5, a grounding terminal and the solenoid 53 of the actuator respectively. A constant-voltage circuit 51 has a regulator 511 and provides a fixed voltage from a terminal 505.

The operation of the unlocking device having the above-described construction will be described below.

Figure 7:
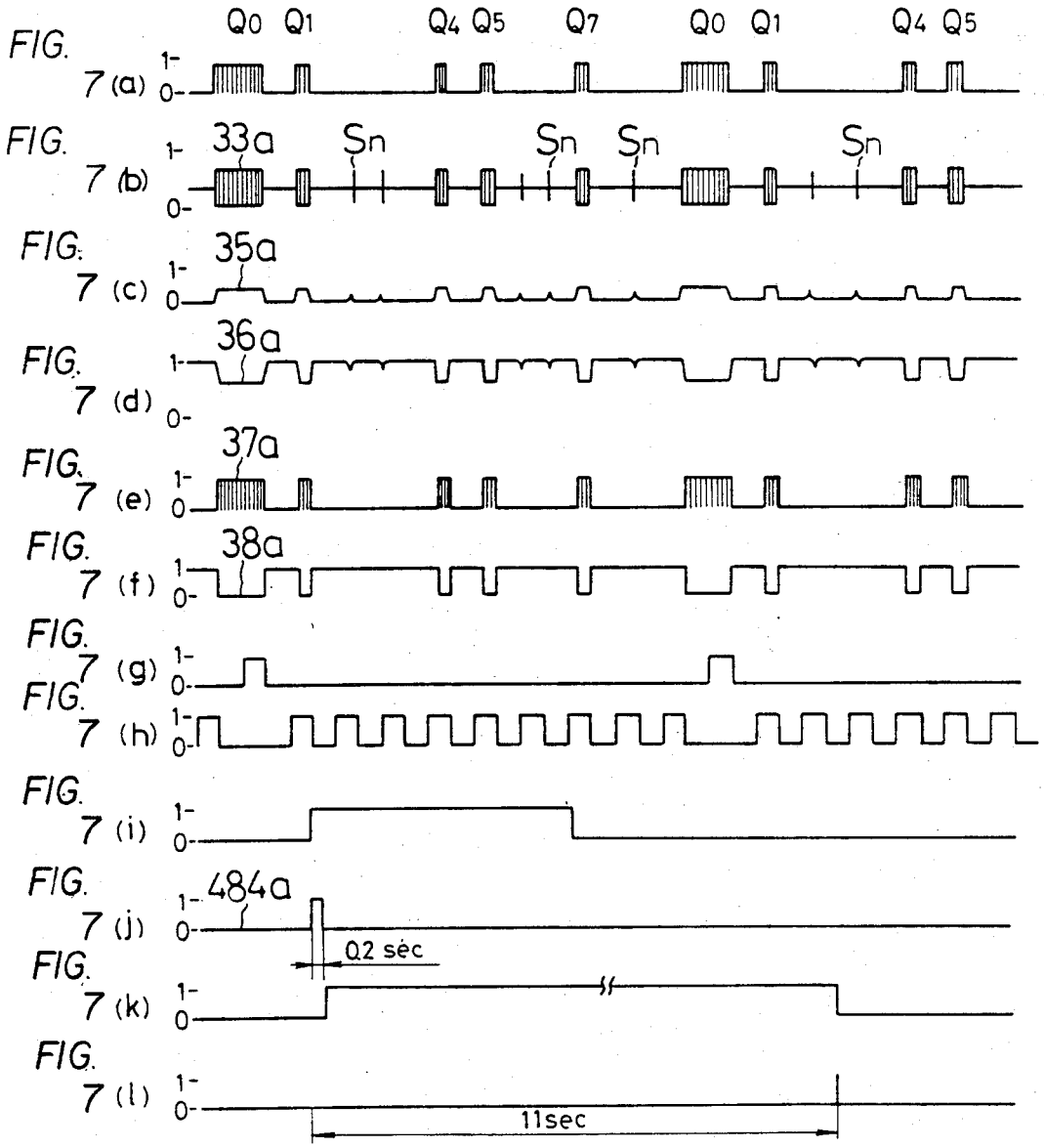

Referring to FIG. 3, when the switch 12 is closed, the oscillation circuit 131 generates a pulse signal of a frequency (in this embodiment, 8 kHz), which is divided by the binary counter 132 and fed to the decimal counter 133. If the output terminals $Q_1$, $Q_4$, $Q_5$ and $Q_7$ of the decimal counter 133 are connected to the NOR gate 134 as illustrated by broken lines, the NOR gate 137 provides an unlocking signal as shown in FIG. 7(*a*) and the coil 15 generates a magnetic signal M corresponding to the unlocking signal. In the unlocking signal of FIG. 7(*a*), $Q_0$ includes 256 pulses of the signal (in this embodiment, 24 kHz) from the terminal $Q_1$ of the binary counter 132, while $Q_1$, $Q_4$, $Q_5$ and $Q_7$ each includes 64 pulses of the same signal. Referring to FIG. 4, the effective sensing range of the magnetic sensor 2 is designed to be within 70 cm. When the signal transmitter 1 is brought within the effective sensing range of the magnetic sensor 2, the magnetic sensor 2 is able to receive the magnetic signal M transmitted by the signal transmitter 1.

An output signal of the magnetic sensor 2 is fed to the buffer 31 for impedance conversion, then the converted signal is fed to the band pass filter 32 to eliminate noises of the commercial frequency band (approximately 60 Hz), and then the filtered signal is amplified by the amplifier 33 to provide a reception signal 33*a* as shown in FIG. 7(*b*).

As shown in FIG. 7(*b*), a plurality of noise pulses Sn overlap the reception signal 33*a*. The reception signal 33*a* is coupled by the condenser 39, and is smoothed by diodes 351 and 352, a condenser 353 and a resistor 354 to absorb the noise pulses and to provide a smoothed signal 35*a* as shown in FIG. 7(*c*). This smoothed signal 35*a* is inverted and amplified by an operational amplifier 361 to provide an inverted signal 36*a* as shown in FIG. 7(*d*). The reception signal 33*a* and the inverted signal 36*a* are amplified by a differential amplifier 37 to provide an unlocking signal 37*a* eliminated of noise as shown in FIG. 7(*e*), because the differential amplifier 37 let the reception signal 33*a* pass only when the voltage level of the reception signal 33*a* changes to be higher than that of the inverted signal 36*a*. The unlocking signal 37*a* is fed to the detection circuit 38, which provides a detection signal 38*a* as shown in FIG. 7(*f*).

In the signal discriminating circuit 40 shown in FIG. 5, the oscillation circuit 41 generates a pulse signal (in this embodiment, a pulse signal of 48 kHz). On the other hand, the detection signal 38*a* is received at the terminal 403 and is transmitted to the terminal R of the binary counter 421 of the reset signal generating circuit 42. Then, the binary counter 421 gives a signal as shown in FIG. 7(*g*) from the terminal $Q_9$. The signal is applied to the respective R terminals of the binary counter 431 and the decimal counter 432 of the address detection circuit 43. The binary counter 431 provides a signal as shown in FIG. 7(*h*) from the terminal $Q_9$. The signal of FIG. 7(*h*) puts the output terminals $Q_0$ to $Q_9$ of the decimal counter 432 sequentially to level "1".

The output signals of the output terminals $Q_0$ to $Q_9$ and the inverted signal of the detection signal 38*a* of a series pulse train are applied to NAND gates 433-*b* to 433-*i* to obtain the logical products of the output signals and the detection signal 38*a*. The results of the operation are provided as an address signal of a parallel pulse train. The level only of parts of the address signal corresponding to the $Q_1$, $Q_4$, $Q_5$ and $Q_7$ of the unlocking signal (FIG. 7(*a*)) are put to "0". The address signal is stored in the memory circuit 44. The output terminals $Q_1$, $Q_4$, $Q_5$ and $Q_7$ of the D latch 442 are put to level "1". The output terminals $Q_1$ to $Q_8$ of the D latch 442, and the NAND gate 451 and the NOR gate 452 of the discriminating circuit 45 are interconnected as shown by broken lines in FIG. 5. Thus the output of the NAND gate 451 is put to level "0" upon the reception of the address signal and the invertor 453 provides a signal of level "1" as shown in FIG. 7(*i*). Consequently, a flip flop 481 is set and one of the outputs is put to level "0" and the output signal of the NOR gate, namely, the unlocking command signal 484*a*, is put to level "1" as shown in FIG. 7(*j*).

At this moment, the other output of the flip flop 481 is put to level "1" to reset the binary counters 461 and 462 of the inhibit circuit 46 and the binary counter 471 and 472 of the time circuit 47 through the invert gate 483. The time circuit 47 divides the pulse signal received from the oscillation circuit 41 to put the output of the terminal $Q_{12}$ of the binary counter 472 to level "1" approximately 0.2 sec later, which is shown in FIG. 7(*k*). Consequently, the division of the binary counter 471 is stopped and the unlocking command signal 484*a* is put to level "0". In the inhibit circuit 46, the output of the terminal $Q_6$ of the binary counter 462 is put to level "1" approximatelly 11 sec later, which is shown in FIG. 7(*l*). Consequently, the flip flop 481 is reset.

Referring to FIG. 6, in the driving circuit 50, the unlocking command signal 484*a* is applied to the terminal 506, so that the unlocking command signal 484*a* sets the transistor 531 ON through the NAND gate 521, and thereby the transistors 532 and 533 are turned ON. Consequently, a driving signal of level "1" is provided from the terminal 504 to actuate the solenoid 53, so that the trunk lid is opened. On the other hand, while the key switch 5 is open, the NAND gate 521 is closed, hence no driving signal is provided.

In the above described embodiment, if such a comparator as to pass the reception signal 33*a* when the signal level of the reception signal 33*a* changes beyond the signal level of the smoothed signal 35*a*, is employed as the comparator 37, the inverting circuit 36 is unnecessary.

Thus, the luggage door unlocking device of the present invention compares the reception signal and the inverted signal produced by smoothing the reception signal and inverting the voltage of the same and admits the reception signal as an unlocking signal only when the voltage level of the reception signal is higher than the voltage level of the inverted signal. Therefore, pulse noise overlapping the reception signal is eliminated effectively to secure reliable function of the luggage door unlocking device.

What is claimed is:

1. A luggage door unlocking device comprising:

a portable signal transmitter capable of transmitting a magnetic unlocking signal comprised of a high-frequency pulse train having a predetermined code;

a magnetic sensor mounted on a vehicle and capable of generating a reception signal upon the reception of the unlocking signal when the signal transmitter is brought near the magnetic sensor;

signal processing means to detect the reception signal and to provide a detection signal;

signal discriminating means to provide an unlocking command signal only when the detection signal corresponds to the predetermined code; and driving means to actuate an unlocking mechanism upon the reception of the unlocking command signal;

said signal processing means including:

a smoothing circuit which smoothes the reception signal and provides a smoothed signal;

an inverting circuit which inverts the signal level of the smoothed signal to provide an inverted signal;

a comparator which receives the reception signal and the inverted signal and lets the reception signal pass only when the signal level of the reception signal changes beyond the signal level of the inverted signal; and a detection circuit which detects the reception signal which has passed the comparator to provide a detection signal of a pulse train corresponding to the reception signal.

2. A luggage door unlocking device according to claim 1, wherein said portable signal transmitter has a built-in power source, a main switch, a transmission circuit adapted to generate an unlocking signal of a specific high-frequency pulse train and a transmission solenoid which transforms the unlocking signal into a magnetic signal and transmits the magnetic signal.

3. A luggage door unlocking device according to claim 1, wherein said smoothing circuit is a RC smoothing circuit and said comparator is a differential amplifier employing an operational amplifier.

4. A luggage door unlocking device according to claim 1, wherein said signal processing means further includes a coupling condenser, which interconnects said magnetic sensor and said smoothing circuit.

5. A luggage door unlocking device according to claim 1, wherein said signal discriminating circuit includes an address detection circuit which converts the series pulse train of said detection signal into a parallel pulse train to provide an address signal and a discriminating circuit which generates an unlocking command signal only when the address signal corresponds to a specific signal.

6. A luggage door unlocking device according to claim 1, wherein said driving means includes a solenoid for actuating the unlocking mechanism and a driving circuit which provides a driving signal upon the reception of the unlocking command signal to energize the solenoid.

7. A luggage door unlocking device according to claim 6, wherein said inverting circuit is an inverting amplifier employing an operational amplifier.

* * * * *